US005390925A

United States Patent [19]

Wiltse

[11] Patent Number: 5,390,925

[45] Date of Patent: Feb. 21, 1995

[54] ADJUSTABLE PUTTING DECK

[76] Inventor: Vern Wiltse, 311 Rambling Ct., Euless, Tex. 76039

[21] Appl. No.: 142,692

[22] Filed: Oct. 26, 1993

[51] Int. Cl.[6] ..... A63B 69/36

[52] U.S. Cl. ..... 273/176 H; 273/195 B

[58] Field of Search ..... 273/176, 32 R, 197.4, 273/35 R, 34 R, 187.1, 197 R, 195 R, 195 B; 108/1, 4, 6, 7, 8, 9

[56] References Cited

U.S. PATENT DOCUMENTS

| | | | |
|---|---|---|---|
| 3,170,694 | 2/1965 | Dolce | 273/176 H |
| 3,831,949 | 8/1974 | Henning | 273/176 H |
| 3,869,127 | 3/1975 | Kohari | 273/195 B |
| 3,897,067 | 7/1975 | Smith | 273/176 H |
| 4,018,436 | 4/1977 | Leigh | 273/176 H |
| 4,240,637 | 12/1980 | Cross et al. | 273/176 H |
| 4,331,332 | 5/1982 | Hughes | 273/195 B |
| 4,613,133 | 9/1986 | Selberg et al. | 273/145 B |
| 4,875,684 | 10/1989 | Benilan | 273/195 B |
| 4,978,127 | 12/1990 | Juel, Jr. | 273/176 H |
| 5,005,837 | 4/1991 | Martinez | 273/195 B |
| 5,082,280 | 1/1992 | Wang | 273/195 B |

*Primary Examiner*—Mark S. Graham

*Attorney, Agent, or Firm*—Robert L. McKellar

[57] ABSTRACT

This invention deals with a new and novel adjustable putting deck for sport and recreation. The device is essentially a flat surface, equipped with putting holes and the capability of adjusting each of four corners of the device at random, to create a putting surface having many configurations.

15 Claims, 2 Drawing Sheets

ADJUSTABLE PUTTING DECK

BACKGROUND OF THE INVENTION

This invention deals with a new and novel adjustable putting deck for sport and recreation.

The device is essentially a flat surface, equipped with putting holes and the capability of adjusting each of four corners of the device at random, to create a putting surface having many configurations. This combination is one of the unique features of the putting deck, and it is the feature that draws the avid golf player to its use. One of the principal objects of the instant invention is to provide a practice green for golfers so that they can practice putting without having to gear up and go out to a golf course. A lot of times, the golfer does not have time to go to a golf course to undertake this practice, and sometimes, the weather prevents the golfer from practicing, even when a trip is made, Further, this invention can be utilized as a game of skill and can provide many hours of entertainment, for example, in a bar room atmosphere, or recreation room or game hall.

PRIOR ART

There are several prior art disclosures dealing with apparati for golf practicing.

U.S. Pat. No. 3,869,127 to Kohori, issued on Mar. 4, 1975, deals with a golf shot practicing apparatus which is a flat base with a flat support board disposed over the base. The flat base has supporting it, a device for tilting the flat base so as to give an inclined surface. Also included in the apparatus is a mat on which to stand when addressing and striking a golf ball. This apparatus is limited in that it can only tilt in one direction at a time. Thus, this device only has the capability of emulating the side of a slope, and cannot provide an undulating surface such as one encounters on a putting green. This apparatus can be said to be a device that is useful for driving a golf ball, rather than putting the golf ball.

Another device is disclosed in U.S. Pat. No. 4,613,133, to Selberg, et al, on Sep. 23, 1986, in which there is disclosed a device similar to that of Kohori, in which there is used a driving device for golf practice, having a platform which has a jack-like adjustment in order to tilt the platform surmounted on the jack's upper surface. This apparatus has the same shortcomings as does the Kohori device, in that it can only be tilted in one direction at a time.

Further disclosure can be found in U.S. Pat. No. 4,875,684, issued to Benilan on Oct. 24, 1989 in which a golf practice deck is described in which there is a fixed stand and an orientable platform. The device can articulate the platform in any direction and provide a sloping surface, however, it too suffers from the same problems as was indicated above, in that it can only provide one tilt direction at a time.

Such is the case with the devices of two other prior art patents, namely, U.S. Pat. No. 5,005,837, to Martinez, which issued on Apr. 9, 1991 and U.S. Pat. No. 5,082,280, to Wang, which issued on Jan. 21, 1992.

Although the device in U.S. Pat. No. 4,331,332, which issued to Hughes on May 25, 1982, appears to have the capability of providing a putting surface having more than one direction associated with it, it only really emulates the other prior art devices by using blocks under the corners to 37 tilt the platform forwardly, rearwardly, and end-to-end in order to simulate fairway conditions". Thus, the device of the '332 patent does not appear to have the capability associated with the device of the instant invention.

The device of the instant invention provides for a putting surface which can be formed by the use of adjustable supports, which allow for the adjustment of the height of each of the corners of the device in order to give an undulating surface. Such a surface is not provided for in any of the prior art devices discussed above. Furthermore, it appears that the surfaces provided for in the prior art are all for driving the golf ball rather than putting the golf ball.

THE INVENTION

The device of the instant invention is new and novel and deals with a tilting putting deck for putting practice as well as a game of skill played by several participants.

Thus, generally, this invention deals with a simulated putting green wherein several planks are covered with an outdoor carpet to simulate a putting green, and the simulated putting green is supported by supports situated adjacent each corner. Putting cups are positioned strategically about the putting surface. The holes may or may not contain golf flags. Where blocks are provided as the means to support the corners of the putting deck, the blocks are eccentrically mounted, and may be rotated into different supporting heights, so that the putting surface may be tilted to emulate the lie of a putting surface.

More specifically, this invention deals with an adjustable putting deck. The putting deck comprises a support structure including two side members and two end members fastened together in an end to end relationship to form an open, essentially rectangular frame, said frame having a top, a bottom, an interior, and an outside bottom edge.

There is also included a flat top, said flat top being detachedly fixed to the interior of the rectangular frame below the top of the frame and being supported primarily by at least two support beam fixed to the support structure. The flat top covers all of the opening provided by the rectangular frame, and the top has a plurality of openings through it.

The support structure has on each of it's side members, essentially near it's outside bottom edge, two, spaced-apart multi-adjustable supports, each said multi-adjustable support being rotatably mounted eccentrically on a fixed shaft which is supported by the support structure, each said multi-adjustable support being capable of being independently adjusted in height by rotation around the shaft thereof.

DETAILED DESCRIPTION OF THE DRAWINGS

Figure 1:
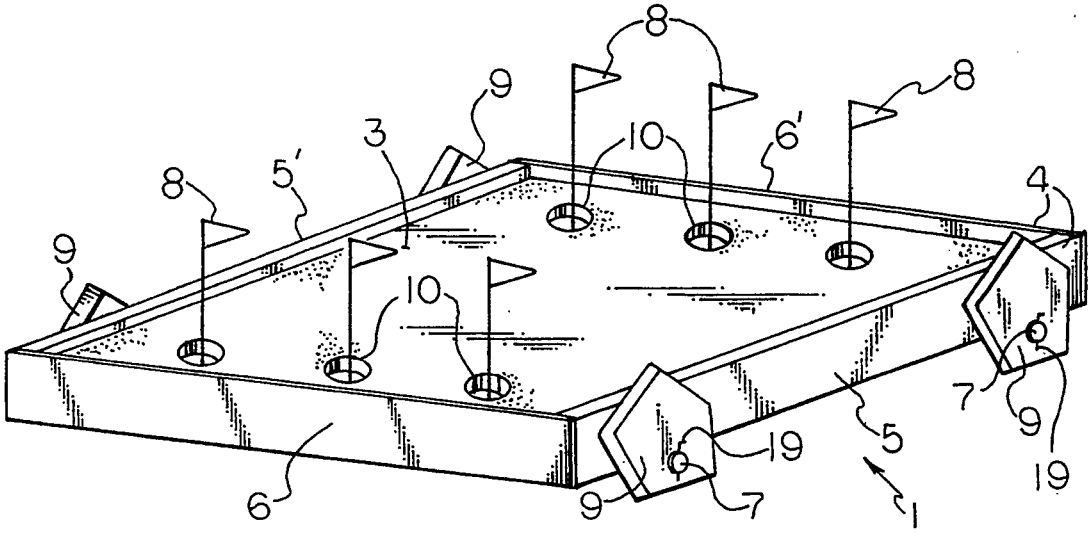
FIG. 1 is a full isometric view of a complete putting deck of this invention.

With reference to FIG. 1, there is shown a full isometric end view of a complete putting deck 1 of this invention in which a deck 2 (not shown in FIG. 1, see FIG. 4 for a partial view), covered with a covering 3, which may be simulated grass or felt or the like, a supporting framework shown generally at 4, two side beams 5 and 5', respectively, two end plates 6 and 6' respectively, shafts 7 under the side of the side beam 5, multiple miniature, ball lifting, flags 8, multiple multi-height adjustable supports 9 and multiple holes 10, for receiving a golf ball (not shown), most of which will be described in detail infra.

Figure 2:
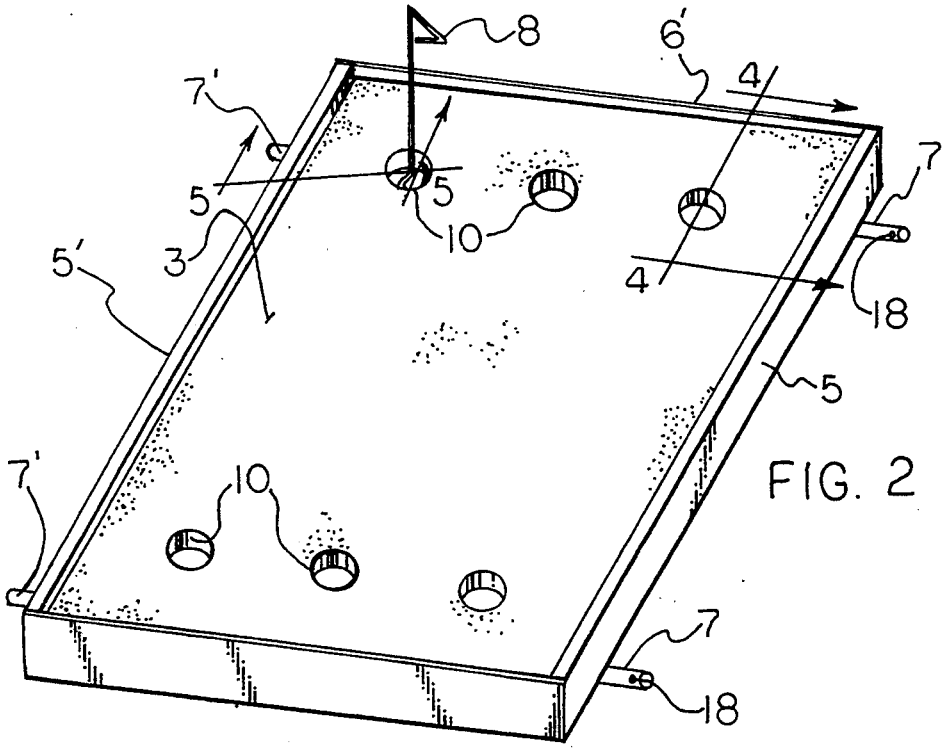
FIG. 2 is an isometric view of a putting deck of this invention without the multi-adjustable supports in place.

With reference to FIG. 2, there is shown an incomplete putting deck 1 in which a clearer view of the shafts 7 and 7' can be taken. It should be noted that the shafts 7 and 7' are part of a set of four such shafts, two of which are shown in the FIG. 2, and which are located on the opposite side of the putting deck 1 from the shafts 7, which means that they are located and attached in side 5' just as shafts 7 are located and attached in side 5. It is contemplated within the scope of this invention to utilize such shafts on either side of the corners of the inventive device, however, as it will become apparent by a further reading of this specification, the ends 6 and 6' are lightweight panels, while the sides 5 and 5' are beam-like supports, and it is preferred to have the supporting function affixed to the stronger of the two. The purpose of each of the shafts 7 and 7' is to rotatably support the multi-height adjustable supports 9 for the deck 1.

Figure 3:
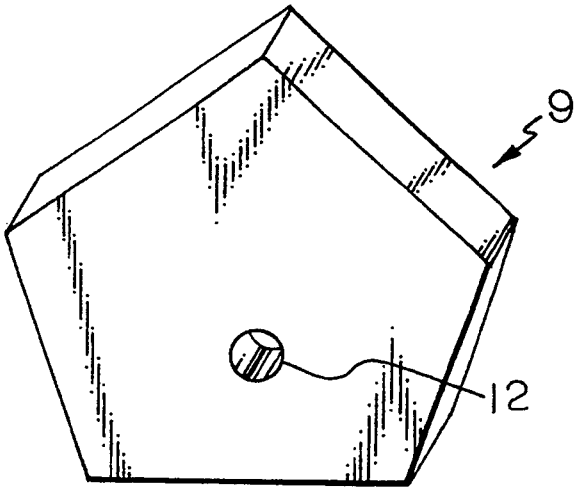
FIG. 3 is an enlarged isometric view of a multi-adjustable support useful in this invention.

Thus, there is shown in FIG. 3, one such embodiment of a multi-height adjustable support 9 for the putting deck 1. Although a pentagonal configuration is shown in FIG. 3 for a multi-height adjustable support 9, it is contemplated within the scope of this invention to use any multi-height adjustable means, as long as each corner of the putting deck 1 is capable of being adjusted to variable heights independently of each of the others. Thus, it is contemplated within the scope of this invention to use multi-sided supports 9. Thus, polygonals such as triangles, rectangles, pentagons, hexagons, and the like will suffice to give the multi-height support that is required in this invention. It is also contemplated within the scope of this invention to use manual jacks at each corner of the putting deck 1 in order to allow for the multi-height adjustability of the putting deck 1.

It should be noted that the pentagon of FIG. 3 has a hole 12 therethrough. This hole accommodates the shafts 7 or 7', as the case may be and the support 9 is thus rotatable around the shaft 7 or 7'. The hole 12 is eccentrically placed in the support 9 and this allows for one to rotate the support 9 to give various heights to the corners of the putting deck 1. It should be obvious to those skilled in the art upon reading this specification, that if the various four corners of the putting deck 1 are adjusted at heights, each different than any other corner, then the surface of the putting deck 1, that is, the deck 2, and the green covering 3 will have an undulating surface. This undulating surface mimics the surface of a putting green and thus allows one to practice putting that emulates the surface of real putting greens. The devices of the prior art cannot provide such a surface, and hence, cannot mimic the surface of a putting green as does the device of this invention.

Figure 4:
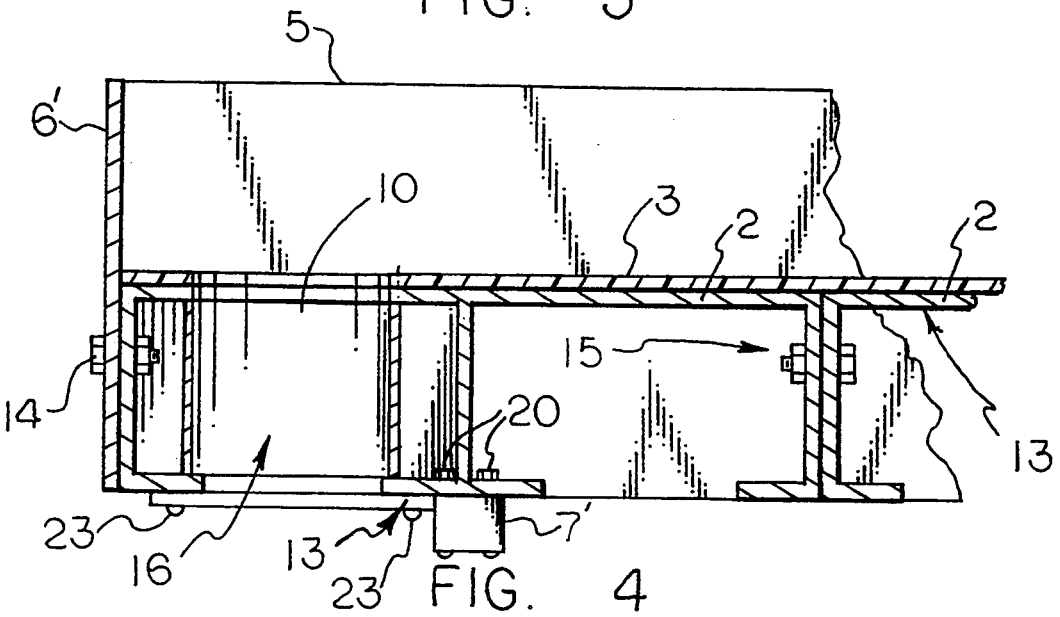
FIG. 4 is an enlarged cross-sectional view of one corner of a putting deck of FIG. 2 through the line 2—2.

Turning now to FIG. 4, wherein there is shown an enlarged cross-sectional view of one corner of the putting deck 1, as shown in FIG. 2, through the lines 2—2.

With regard to FIG. 4, there is shown the end 6 of the support structure 4, bolted to and supporting a deck plank wherein a bolt 14 is shown holding the two pieces together in order to provide stability to the support structure 4. In order to provide additional support for the putting deck 1, the deck planks 13 are also bolted together such as at 15, using a bolt 14. Overlaying the deck 2 is a covering 3, which may be any material, but is preferred to be simulated grass, artificial turf, felt or the like, in order to simulate the grass on a putting green. Also shown in this Figure is a cup 16, ball support bar 22 and screws 23, and the hole 10, which receives the cup 16. It should be noted that the sides 5 and 5' differ in structure from the ends 6 and 6' in order to accommodate the flexibility of the deck 2, when it contorted by the adjustable supports 9 not being at the same height. For example, it is contemplated within the scope of this invention to manufacture the putting deck out of any flexible material, such as plastics, wood, metals, and the like. The best support and durability is provided from a putting deck 1 manufactured from metal. The most preferred metal is lightweight aluminum.

In the construction of the putting deck 1 of this invention, it is preferred to use aluminum planks for the deck, such as those shown at FIG. 4, and indicated as 13. Further, it is preferred that the aluminum planks run from side to side, rather than from end to end of the putting deck 1, in order to allow for enough flexibility and rotation of the planks to accommodate the different adjustments in height of the four corners of the deck 1.

Thus, in manufacturing the putting deck 1, the aluminum plank 13 can be bolted directed to the ends 6 and 6' of the putting deck 1 because these sides, and the sides of the aluminum plank 13 are smooth and flat and provide ease of manufacture.

Figure 5:
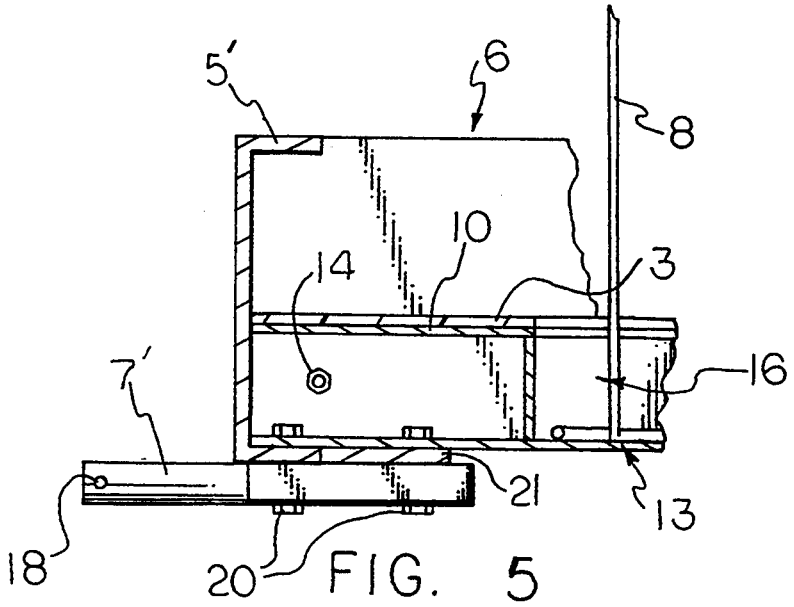
FIG. 5 is an enlarged partial cut-away of another corner of a putting deck of FIG. 2 through the line 3—3.

However, with regard to the sides 5 and 5' and their interface with the aluminum planks 13, it is preferred to allow the planks 13 to lie on, and be supported by a light aluminum rail 5, as shown in FIG. 5. FIG. 5 is a cut-away section of one corner of the putting deck 1, along lines 3—3, as shown in FIG. 2. Thus, with regard to FIG. 5, there is shown the side wall 5' a shaft 7' said shaft 7' having a small hole 18 therethrough to accommodate a pin 19 (shown in FIG. 1). Part of the shaft 7' is shown in phantom in FIG. 5, and in the phantom part, there is shown, also in phantom, four bolts 20 which are used to fix the shaft to the plank 13, interiorly of the side wall 5'. Bolt 14 is also shown. The cut-away portion of FIG. 5 thus exposes the plank 13, and the covering 3, along with the supporting bar 21 for the plank 13. It should be obvious to those skilled in the art upon reading this specification, that a similar bar is used to support the other ends of the planks 13, such bar being bolted adjacent the interior of the side wall 5.

Further shown in FIG. 5 is the end 6, a cup 16, a hole 10 and a miniature flag and ball lifter, 8.

In use, one can putt on the flat surface of the covering on the deck, or one can adjust each multi-height adjustable support to provide an undulating surface. Thus, one can emulate the surface of a putting green with this device.

The inventor herein has constructed a putting deck described herein, and finds that the overall dimensions of the putting deck are preferred in the range of four to six feet wide and six to ten feet long. This provides enough area to the surface of the putting deck to allow for long, smooth undulating surfaces, while providing an economical putting deck. Furthermore, eventhough the deck is manufactured primarily out of aluminum, a deck exceeding the dimensions set forth above, could become quite heavy and awkward to transport and handle. Thus, eventhough the deck could be of essentially any size, it is preferred to manufacture the deck within the specifications on size set forth above.

It should be further understood by those skilled in the art that the multi-height adjustable supports can be of any practical size, the considerations being outside dimensions that do not allow one to grossly exceed the potential warp of the deck and cause bends, creases, or wrinkles in the surface of the planks or support system. For the outside dimensions of the deck as described above, it is believed that the multi-height adjustable support members should not exceed about 12 to 14 inches in height.

I claim:

1. An adjustable putting deck, said putting deck comprising a support structure including two side members and two end members fastened together in an end to end relationship to form an open, essentially rectangular frame, said frame having a top, a bottom, an interior, and an outside bottom edge;

a flexible flat top, said flat top being detachedly fixed to the interior of the rectangular frame below the top of the frame and being supported primarily by at least two support beams fixed to the support structure, said flat top covering all of the opening provided by the rectangular frame, said top having a plurality of openings therethrough;

said support structure having on each of its side members, essentially near its outside bottom edge, two, spaced-apart multi-height adjustable supports, each said multi-height adjustable support being rotatably mounted eccentrically on a fixed shaft which is supported by the support structure, each said multi-height adjustable support being capable of being independently adjusted in height by rotation around the shaft thereof.

2. A deck as claimed in claim 1 wherein there are at least two said openings in the flat top.

3. A deck as claimed in claim 2 wherein the openings are standard golf cup openings.

4. A deck as claimed in claim 3 wherein the openings contain miniature flag and ball lifting posts.

5. A deck as claimed in claim 1 wherein the flat top is covered with a covering.

6. A deck as claimed in claim 5 wherein the covering is artificial grass.

7. A deck as claimed in claim 5 wherein the covering is felt.

8. A deck as claimed in claim 6 wherein the felt is colored green.

9. A deck as claimed in claim 1 wherein the total surface area of the flat top is at least 25 square feet and the shortest side member or end member of the rectangular frame is about two feet.

10. A deck as claimed in claim 1 wherein the multi-height adjustable supports are polygonal wheels.

11. A deck as claimed in claim 10 wherein the polygonal wheels are pentagonal.

12. A deck as claimed in claim 10 wherein the polygonal wheels are hexagonal.

13. A deck as claimed in claim 10 wherein the polygonal wheels are heptagonal.

14. A deck as claimed in claim 10 wherein the polygonal wheels are octagonal.

15. A deck as claimed in claim 10 wherein the polygonal wheels are color coded with regard to height.

* * * * *